US008860641B2

(12) United States Patent
Yamamoto

(10) Patent No.: US 8,860,641 B2
(45) Date of Patent: Oct. 14, 2014

(54) CONTROL DEVICE, ELECTROOPTICS DEVICE, ELECTRONIC APPARATUS, AND CONTROL METHOD

(71) Applicant: Seiko Epson Corporation, Tokyo (JP)

(72) Inventor: Takekuni Yamamoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 106 days.

(21) Appl. No.: 13/671,756

(22) Filed: Nov. 8, 2012

(65) Prior Publication Data

US 2013/0127933 A1 May 23, 2013

(30) Foreign Application Priority Data

Nov. 21, 2011 (JP) ..... 2011-254245

(51) Int. Cl.
*G09G 3/36* (2006.01)
*G09G 3/34* (2006.01)

(52) U.S. Cl.
CPC ..... *G09G 3/344* (2013.01); *G09G 2300/0842* (2013.01); *G09G 2320/041* (2013.01)
USPC ..... 345/87; 345/89; 345/100; 345/107; 345/204

(58) Field of Classification Search
USPC ..... 345/87–100, 204, 690, 107
See application file for complete search history.

(56) References Cited

U.S. PATENT DOCUMENTS

2009/0256798 A1 10/2009 Low et al.
2010/0053225 A1* 3/2010 Furukawa et al. ..... 345/690
2011/0001748 A1 1/2011 Rutman et al.
2011/0141157 A1* 6/2011 Hiroshima ..... 345/690
2011/0279432 A1 11/2011 Yamada
2012/0044232 A1 2/2012 Yamada et al.
2013/0120473 A1* 5/2013 Yamada ..... 345/690

FOREIGN PATENT DOCUMENTS

JP 2009-251615 A 10/2009
JP 2011-237709 A 11/2011

* cited by examiner

*Primary Examiner* — Jennifer Nguyen
(74) *Attorney, Agent, or Firm* — ALG Intellectual Property, LLC

(57) ABSTRACT

An acquisition device acquires temperature information indicative of temperature. When rewriting of the gray level of a target pixel to be processed among plural pixels starts, in case the temperature indicated by the temperature information acquired by the acquisition device is less than a threshold value, a remainder frequency setting device writes a value b (b<a) as a counter value (a remainder frequency) stored in a remainder frequency memory, for the target pixel, through a memory control device. After passing the predetermined period, when a condition to select b-number of the predetermined periods from among a-number of the predetermined periods is met, a remainder frequency update device decrements the counter value stored in the remainder frequency memory through the memory control device.

8 Claims, 6 Drawing Sheets

FIG. 9

| Frame | 1 | 2 | 3 | 4 | 5 | 6 | 7 |
|---|---|---|---|---|---|---|---|
| Decrement | ○ | — | — | ○ | — | — | ○ |
| R | 2 | 2 | 2 | 1 | 1 | 1 | 0 |

FIG. 10

| Frame | 1 | 2 | 3 | 4 | 5 | 6 | 7 | 8 | 9 | 10 |
|---|---|---|---|---|---|---|---|---|---|---|
| Decrement | ○ | — | ○ | ○ | — | ○ | ○ | — | ○ | ○ |
| R | 6 | 6 | 5 | 4 | 4 | 3 | 2 | 2 | 1 | 0 |

FIG. 11

| Frame | 1 | 2 | 3 |
|---|---|---|---|
| Decrement | ○ | ○ | ○ |
| R | 2 | 1 | 0 |

FIG. 12

| Frame | 1 | 2 | 3 | 4 | 5 | 6 | 7 | 5 | 6 | 7 |
|---|---|---|---|---|---|---|---|---|---|---|
| Decrement | ○ | — | — | ○ | — | — | ○ | — | — | ○ |
| R (Pixel A) | 2 | 2 | 2 | 1 | 1 | 1 | 0 | 0 | 0 | 0 |
| R (Pixel B) | 0 | 0 | 0 | 2 | 2 | 2 | 1 | 1 | 1 | 0 |

CONTROL DEVICE, ELECTROOPTICS DEVICE, ELECTRONIC APPARATUS, AND CONTROL METHOD

BACKGROUND

1. Technical Field

The present invention relates to the technology that controls an electro-optic device in which an image can be written by voltage application multiple times.

2. Related Art

Display devices such as electrophoretic display devices may perform each set of rewriting using plural frames. Such rewriting operation is performed when the display element requires a relatively long time to change its display state (i.e., the gray level). When such rewriting is performed, the display element cannot begin the following rewriting unless one set of rewriting is completed (in other words, unless the time for the plural frames passes).

Japanese Laid-open Patent Application 2009-251615 (Patent Document 1) describes a technology to rewrite an image in the unit of a partial area by performing pipeline processing in a display device such as an electrophoretic display device. According to this technology, for an area where rewriting is not being executed, rewriting of that area can be started without depending on rewriting of other areas, and the time required for rewriting may be shortened, compared with the case where the entire image is rewritten.

In the case of the technology described in Patent Document 1, to rewrite plural areas in parallel, pipelines are necessary for the number of the areas. In other words, the number of areas that can be rewritten in parallel is limited by the number of pipelines in the technology described in Patent Document 1. Moreover, in the technology described in Patent Document 1, when a certain area to be rewritten and another area overlap each other, rewriting of the other area cannot be started until after the present rewriting of the area to be rewritten is completed.

SUMMARY

In accordance with some aspects of the invention, in a display device that rewrites an image by voltage application multiple times, a technology that improves the apparent rewriting speed perceived by the user can be provided.

A control device in accordance with an embodiment of the invention includes: a memory control device that controls access, for each of plural pixels corresponding to plural electro-optic elements whose optical state changes from a first state to a second state by voltage application a times each in a predetermined period as the unit, to a first memory that stores a present gray level value, a second memory that stores a gray level value to be displayed next, and a third memory that stores a counter value according to a remainder frequency of voltage applications; an acquisition device that acquires temperature information indicative of temperature; a remainder frequency setting device that, when rewriting of the gray level of a target pixel to be processed among the plural pixels starts when the temperature indicated by the temperature information acquired by the acquisition device is less than a threshold value, writes a value b (b<a) as the counter value stored in the third memory, for the target pixel, through the memory control device; a drive control device that, when the remainder frequency indicated by the counter value stored in the third memory is not zero for the target pixel, controls to apply a voltage to the target pixel; and a remainder frequency update device that, after passing the predetermined period, when a condition to select b-number of the predetermined periods from among a-number of the predetermined periods is met, decrements the counter value stored in the third memory through the memory control device. According to the control device described above, the apparent rewriting speed perceived by the user can be improved, compared with a composition in which the rewriting operation in an area to be newly rewritten starts after the ongoing rewriting operation is completed.

In accordance with a preferred aspect of the embodiment, the control device may have a memory device that stores a table including plural sets of temperature and voltage application frequency, and the a-number may be the maximum value of the voltage application frequency contained in the table. According to this control device, the memory capacity of the third memory can be reduced to a size smaller than In (a) bits.

In accordance with a preferred aspect of the embodiment, the control device may have a decision device that decides the condition according to the temperature acquired by the acquisition device. According to this control device, it is possible to perform the operation according to a voltage application frequency that differs depending on the temperature, by using the third memory with a memory capacity that is smaller than the In (a) bits.

In accordance with another embodiment, an electro-optic device has one of the control devices described above and the plural electro-optic elements. According to such an electro-optic device, the apparent rewriting speed perceived by the user can be improved, compared with a composition in which the rewriting operation in an area to be newly rewritten starts after the ongoing rewriting operation is completed.

Moreover, in accordance with still another embodiment, an electronic apparatus having the electro-optic device described above is provided. According to the electronic apparatus, the apparent rewriting speed perceived by the user can be improved, compared with a composition in which the rewriting operation in an area to be newly rewritten starts after the ongoing rewriting operation is completed.

In accordance with a further embodiment of the invention, a control method for controlling an electro-optic device is provided. The electro-optic device may include a plurality of electro-optic elements whose optical state changes from a first state to a second state by voltage application a times each in a predetermined period as the unit, a control device, and a memory control device that controls access, for each of plural pixels corresponding to the plural electro-optic elements, to a first memory that stores a present gray level value, a second memory that stores a gray level value to be displayed next, and a third memory that stores a counter value according to a remainder frequency of voltage applications. The control method, which may be performed by the control device, includes: acquiring temperature information indicative of temperature; when rewriting of the gray level of a target pixel to be processed among the plural pixels starts when the temperature indicated by the temperature information acquired by the acquisition device is less than a threshold value, writing a value b (b<a) as the counter value stored in the third memory, for the target pixel; when the remainder frequency indicated by the counter value stored in the third memory is not zero for the target pixel, controlling to apply a voltage to the target pixel; and, after passing the predetermined period, when a condition to select b-number of the predetermined periods from among a-number of the predetermined periods is met, decrementing the counter value stored in the third memory through the memory control device. According to the control method, the apparent rewriting speed perceived by the user can be improved, compared with a composition in which the rewriting operation in an area to be newly rewritten starts after the ongoing rewriting operation is completed.

BRIEF DESCRIPTION OF THE DRAWINGS

FIG. 9 is a table showing an example of changes in the value of the remainder frequency R.

FIG. 10 is a table showing another example of changes in the value of the remainder frequency R.

FIG. 11 is a table showing a further example of changes in the value of the remainder frequency R.

FIG. 12 is a table showing an example of changes in the values of the remainder frequency R for two pixels.

DESCRIPTION OF EXEMPLARY EMBODIMENTS

1. Configuration

Figure 1:
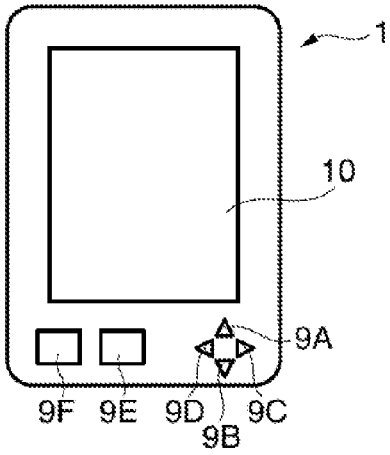
FIG. 1 is a view of an external appearance of an electronic apparatus 1.

FIG. 1 is a view of the external appearance of an electronic apparatus 1 in accordance with an embodiment. The electronic apparatus 1 may be a display apparatus that displays images. In this example, the electronic apparatus 1 is a device for reading electronic books (an example of documents), in other words, an electronic book reader. An electronic book is composed of data including images of a plurality of pages. The electronic apparatus 1 displays the electronic book in a display section 10 by a certain unit (for instance, one page by one page). Among plural pages included in the electronic book, a target one page to be displayed is called a "selection page." The selection page is changed according to the operation of buttons 9A-9F by the user. In other words, the user can turn over the pages (turn the pages forward or backward) of the electronic book by operating the buttons 9A-9F.

Figure 2:
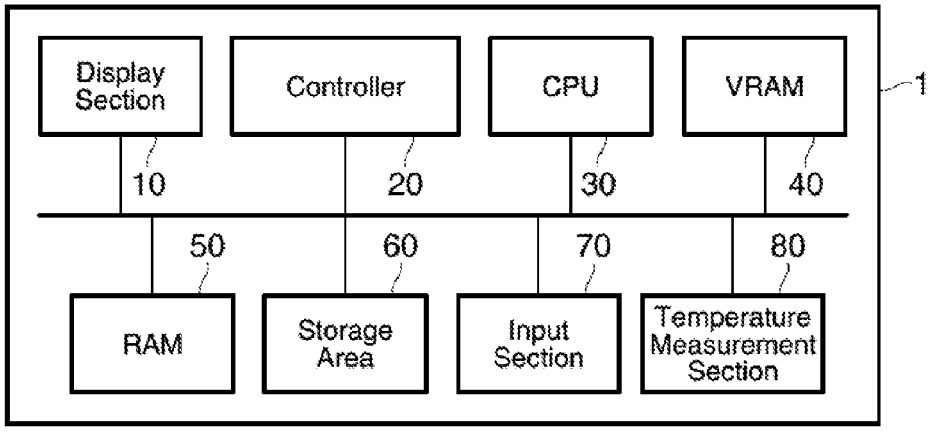
FIG. 2 is a block diagram of a hardware configuration of an electronic apparatus 1.

FIG. 2 is a block diagram of a hardware configuration of the electronic apparatus 1. The electronic apparatus 1 includes a display section 10, a controller 20, a CPU (Central Processing Unit) 30, a VRAM (Video Random Access Memory) 40, a RAM (Random Access Memory) 50, a storage section 60, an input section 70, and a temperature measuring section 80. The display section 10 has a display panel including display elements for displaying an image. In this example, the display section 10 includes display elements using electrophoretic particles, as display elements having the memory-property that retains a display state without supplying energy through voltage application or the like. The display section 10 displays an image in monochrome multiple gray levels (in this example, two gray levels of black and white) with the display elements. The controller 20 is a control device that controls the display section 10. The CPU 30 is a device that controls each of the sections of the electronic apparatus 1. The CPU 30 uses the RAM 50 as a work area, and executes a program stored in a ROM (Read Only Memory, not shown) or the storage section 60. The VRAM 40 is a memory that stores image data indicative of an image to be displayed on the display section 10. The RAM 50 is a volatile memory that stores data. The storage section 60 is a storage device that stores various data and application programs, in addition to data of electronic books (book data), and includes an HDD (Hard Disk Drive) or a nonvolatile memory such as a flash memory. The storage section 60 is capable of storing data of a plurality of electronic books. The input section 70 is an input device for inputting user's instructions, and includes, for example, a touch screen, key pads, buttons or the like. The temperature measurement section 80 is a device that measures temperature, such as, for example, a thermistor. The components described above are interconnected through a bus.

Figure 3:
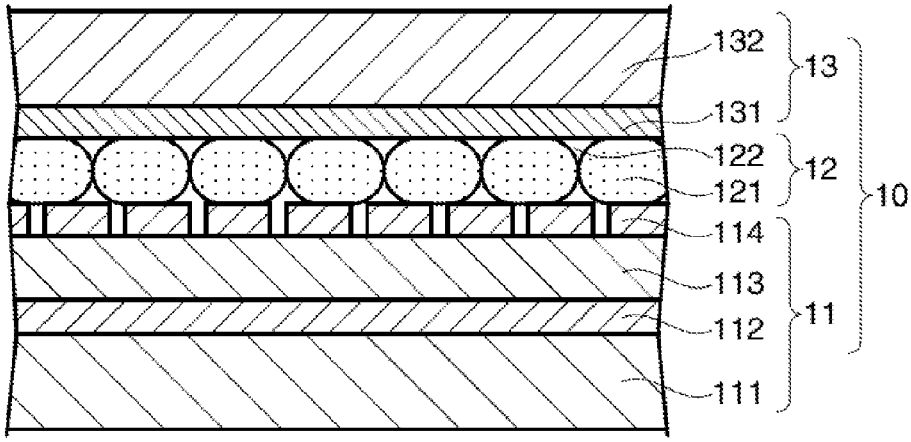
FIG. 3 is a schematic view of a cross-sectional structure of a display section 10.

FIG. 3 is a schematic view of a cross-sectional structure of the display section 10. The display section 10 includes a first substrate 11, an electrophoretic layer 12, and a second substrate 13. The first substrate 11 and the second substrate 13 are substrates for retaining the electrophoretic layer 12.

The first substrate 11 includes a substrate 111, a bonding layer 112 and a circuit layer 113. The substrate 111 is made of a material having dielectric property and flexibility, for example, a polycarbonate substrate. It is noted that the substrate 111 may be made of any resin material other than polycarbonate, as long as the resin material is light-weight, flexible, elastic and dielectric. As another example, the substrate 111 may be formed from glass material without flexibility. The bonding layer 112 is a layer that bonds the substrate 111 and the circuit layer 113 together. The circuit layer 113 is a layer having a circuit for driving the electrophoretic layer 12. The circuit layer 113 has pixel electrodes 114.

The electrophoretic layer 12 includes microcapsules 121 and a binder 122. The microcapsules 121 are fixed by the binder 122. The binder 122 may be made of any material that has good affinity with the microcapsules 121, excellent adhesion to the electrodes, and dielectric property. Each of the microcapsules 121 is a capsule containing a dispersion medium and electrophoretic particles. The microcapsules 121 may preferably be made of a material having flexibility, such as, composites of gum Arabic and gelatin, urethane compounds, and the like. It is noted that an adhesive layer made of adhesive may be provided between the microcapsules 121 and the pixel electrodes 114.

As the dispersion medium, it is possible to use any one of materials including water; alcohol solvents (such as, methanol, ethanol, isopropanol, butanol, octanol, and methyl cellosolve); esters (such as, ethyl acetate and butyl acetate); ketones (such as, acetone, methyl ethyl ketone, and methyl isobutyl ketone); aliphatic hydrocarbons (such as, pentane, hexane, and octane); alicyclic hydrocarbons (such as, cyclohexane and methylcyclohexane); aromatic hydrocarbons (such as, benzene, toluene, long-chain alkyl group-containing benzenes (such as, xylenes, hexylbenzene, heptylbenzene, octylbenzene, nonylbenzene, decylbenzene, undecylbenzene, dodecylbenzene, tridecylbenzene, and tetradecylbenzene)); halogenated hydrocarbons (such as, methylene chloride, chloroform, carbon tetrachloride, and 1,2-dichloroethane); and carboxylates. Also, the dispersion medium may be made of any one of other various oils. The dispersion medium may use any of the materials described above in combination, and may further be mixed with a surfactant.

The electrophoretic particles are particles (polymer or colloid) having a property in which the particles move in the dispersion medium by electric fields. In the present embodiment, white electrophoretic particles and black electrophoretic particles are contained in each of the microcapsules 121. The black electrophoretic particles are particles including black pigments, such as, for example, aniline black, carbon black and the like, and are positively charged in the present embodiment. The white electrophoretic particles are particles including white pigment, such as, for example, titanium dioxide, aluminum oxide and the like, and are negatively charged in the present embodiment.

The second substrate 13 includes a common electrode 131 and a film 132. The film 132 seals and protects the electrophoretic layer 12. The film 132 may be formed from a material that is transparent and has a dielectric property, such as, for example, polyethylene terephthalate. The common electrode 131 is made of a transparent conductive material, such as, for example, indium tin oxide (ITO).

Figure 4:
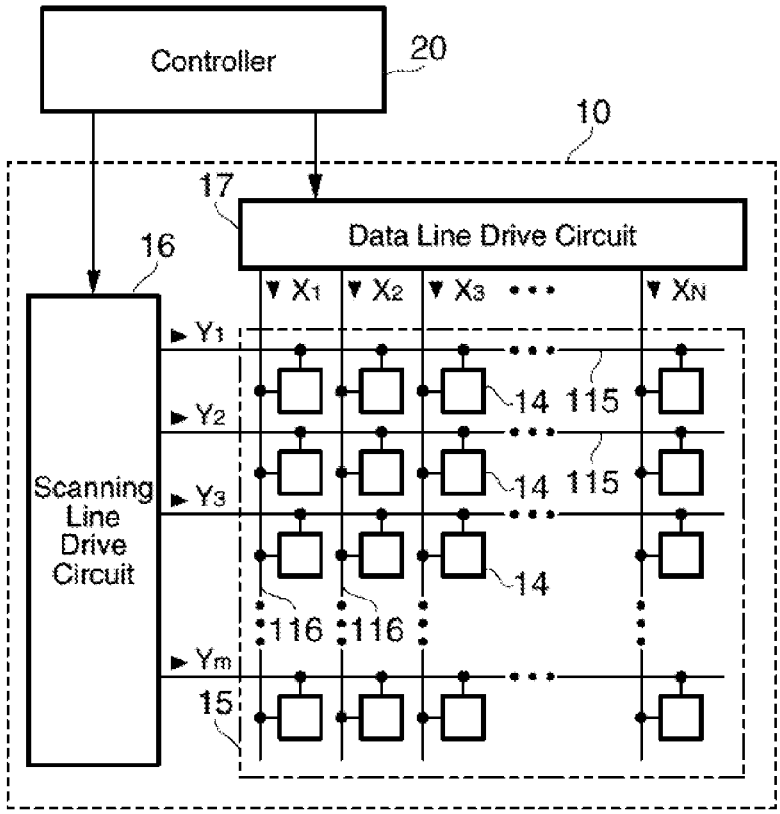
FIG. 4 is a diagram of a circuit configuration of the display section 10.

FIG. 4 is a diagram showing a circuit configuration of the display section 10. The display section 10 and the controller 20 jointly form an electro-optic device. The display section 10 includes m scanning lines 115, n data lines 116, m×n pixels 14, a scanning line drive circuit 16, and a data line drive circuit 17. The scanning line drive circuit 16 and the data line drive circuit 17 are controlled by the controller 20. The scanning lines 115 are arranged along a row direction (x direction), and transmit a scanning signal. The scanning signal is a signal that sequentially, exclusively selects one scanning line 115 from among the m scanning lines 115. The data lines 116 are arranged along a column direction (y direction), and transmit data signals. The data signals are signals indicative of gray levels of each pixel. The scanning lines 115 are insulated from the data lines 116. The pixels 14 are provided at positions corresponding to intersections between the scanning lines 115 and the data lines 116, and exhibit gray levels according to the respective data signals. It is noted that, when one scanning line 115 among the plurality of scanning lines 115 needs to be distinguished from the others, it is called the scanning line 115 in the first row, the second row, . . . , or the $m^{-th}$ row. The data lines 116 may be similarly distinguished. The m×n pixels 14 form a display region 15. Among the display region 15, when a pixel 14 at the $i^{-th}$ row and the $j^{-th}$ column is to be distinguished from the others, it is referred to as a pixel (j, i). Parameters that have one-to-one correspondence with the pixels 14, such as, gray level values and the like are similarly expressed.

The scanning line drive circuit 16 outputs a scanning signal Y for sequentially, exclusively selecting one scanning line 115 from among the m scanning lines 115. The scanning signal Y is a signal that sequentially, exclusively assumes H (High) level. The data line drive circuit 17 outputs data signals X. The data signals X are signals indicative of data voltages corresponding to gray level values of pixels. The data line drive circuit 17 outputs data signals indicative of data voltages corresponding to pixels in a row selected by the scanning signal. The scanning line drive circuit 16 and the data line drive circuit 17 are controlled by the controller 20.

Figure 5:
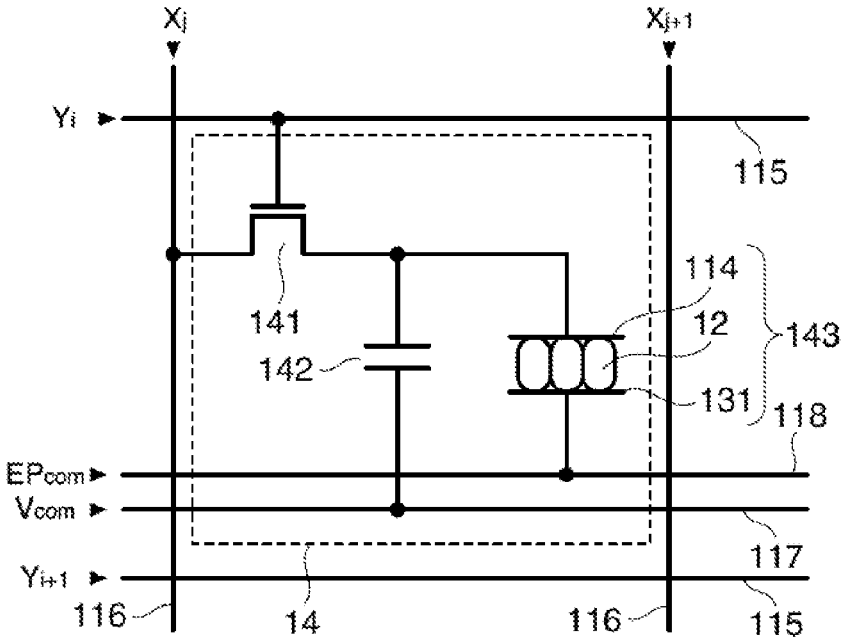
FIG. 5 is a diagram of an equivalent circuit of a pixel 14.

FIG. 5 is a diagram showing an equivalent circuit of the pixel 14. The pixel 14 includes a transistor 141, a capacitance 142, and an electrophoretic element 143. The electrophoretic element 143 includes a pixel electrode 114, an electrophoretic layer 12, and a common electrode 131. The transistor 141 is an example of a switching device for controlling data writing to the pixel electrode 114, for example, an n-channel TFT (Thin Film Transistor). The transistor 141 includes a gate, a source and a drain, connected to the scanning line 115, the data line 116 and the pixel electrode 114, respectively. When a scanning signal at L (Low) level (non-selection signal) is inputted in the gate, the source and the drain of the transistor 61 are insulated from each other. When a scanning signal at H (High) level (selection signal) is inputted in the gate, the source and the drain of the transistor 141 become conductive to each other, and a data voltage is written to the pixel electrode 114. Also, the drain of the transistor 141 connects to the capacitance 142. The capacitance 142 retains a charge according to the data voltage. The pixel electrode 114 is provided at each of the pixels 14, and disposed opposite the common electrode 131. The common electrode 131 is commonly shared by the entire pixels 14, and is given a potential EPcom. The electrophoretic layer 12 is held between the pixel electrode 114 and the common electrode 131. The pixel electrode 114, the electrophoretic layer 12 and the common electrode 131 form the electrophoretic element 143. A voltage corresponding to a potential difference between the pixel electrode 114 and the common electrode 131 is applied to the electrophoretic layer 12. In the microcapsules 121, the electrophoretic particles move according to a voltage applied to the electrophoretic layer 12, thereby expressing a gray level. When the potential on the pixel electrodes 114 is positive (for example, +15V) with respect to the potential EPcom on the common electrode 131, the negatively charged white electrophoretic particles move toward the pixel electrode 114, and the positively charged black electrophoretic particles move toward the common electrode 131. As the display section 10 is viewed from the side of the second substrate 13, the pixels appear in black. When the potential on the pixel electrodes 114 is negative (for example, −15V) with respect to the potential EPcom on the common electrode 131, the positively charged black electrophoretic particles move toward the pixel electrodes 114, and the negatively charged white electrophoretic particles move toward the common electrode 131. In this instance, the pixels appear in white.

Note that, in the following description, a period starting from the selection of the scanning line in the $1^{st}$ row by the scanning line drive circuit 16 until the end of the selection of the scanning line in the m-$^{th}$ row is referred to as a "frame period" or, simply a "frame." Each of the scanning lines 115 is selected once in each frame, and a data signal is supplied to each of the pixels 14 once in each frame.

Figure 6:
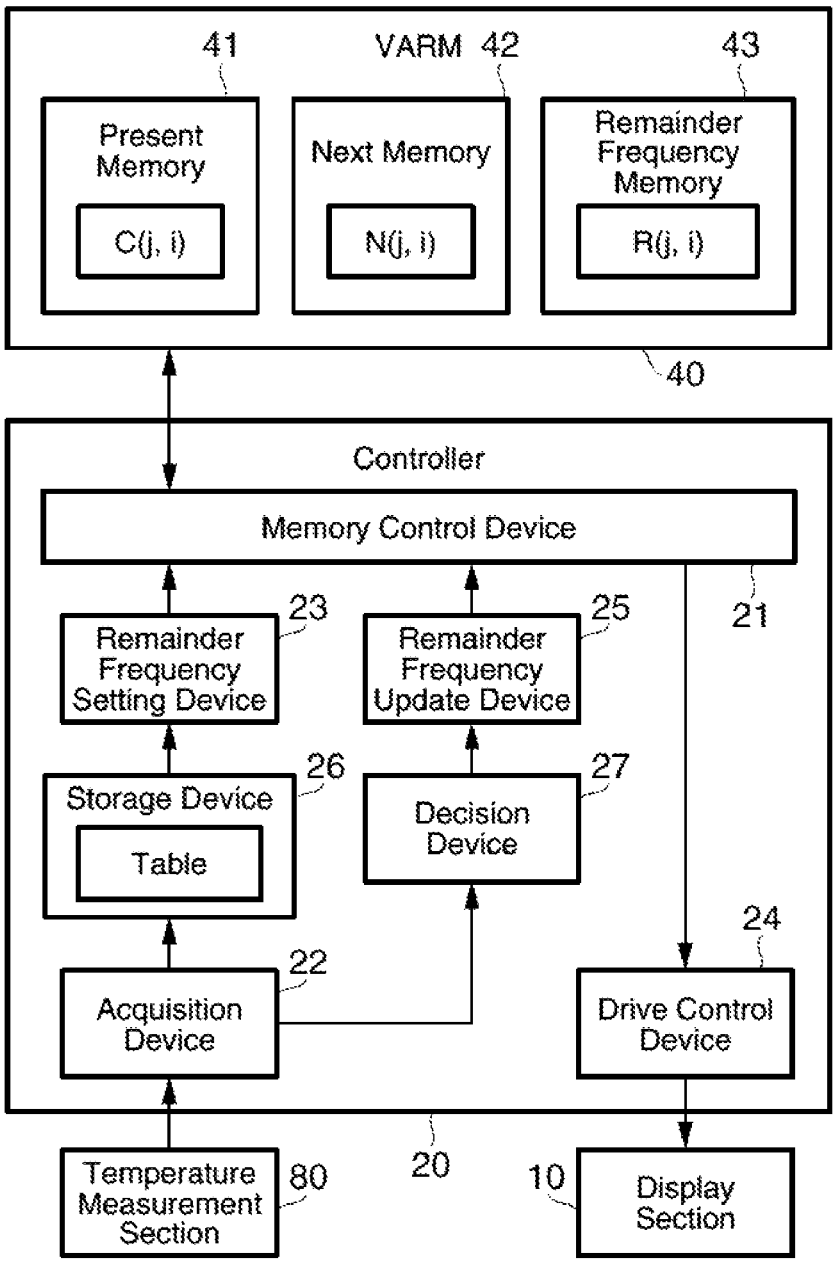
FIG. 6 is a block diagram of a functional configuration of a controller 20.

FIG. 6 is a block diagram showing the functional composition of the electronic apparatus 1 (in particular, the controller 20). The VRAM 40 has a present memory 41 (an example of the first memory), a next memory 42 (an example of the second memory), and a remainder frequency memory 43 (an example of the third memory). The present memory 41 is a memory that stores a present gray level value C (j, i) for each of the multiple pixels 14. An image shown by data stored in the present memory 41 is called a "present image." Note that the present gray level value C (j, i) or the "present pixel" may not necessarily express an image at the present time at all timings, but, at least, express the gray level value of the pixel when a predetermined rewriting sequence is completed. The plural pixels 14 correspond to the plural electrophoretic elements 143 (one example of the electro-optic elements) whose optical state changes from a first state (for instance, black) into a second state (for instance, white) by voltage application a times each in a predetermined period as the unit (for instance, a frame). The next memory 42 is a memory that stores a gray level value N (j, i), for each of the plural pixels, to be displayed in the next period (frame) or later, that is, an image to which writing is scheduled next. An image expressed by the data stored in the next memory 42 is called a "next image." The remainder frequency memory 43 is a memory that stores the remainder frequency R (j, i) of voltage applications for each of the plural pixels 14. Note that, in the present embodiment, the value of the remainder frequency R and the remainder frequency of voltage applications do not necessarily correspond one-to-one, as described later.

The controller 20 has a memory control device 21, an acquisition device 22, a remainder frequency setting device 23, a drive control device 24, and a remainder frequency update device 25. The memory control device 21 controls the access (data write or read) to the VRAM 40. The acquisition device 22 acquires temperature information indicative of the temperature. In this example, the acquisition device 22 acquires temperature information from the temperature measurement section 80. When the temperature indicated by temperature information acquired by the acquisition device 22 is below a threshold value, and rewriting of the gray level on a target pixel to be processed among plural pixels is to be started, the remainder frequency setting device 23 writes b (b<a; a and b are natural numbers), for the target pixel, as a counter value (a remainder frequency) stored in the remainder frequency memory 43 through the memory control device 21. When the remainder frequency, for the target pixel, indicated by the counter value stored in the remainder frequency memory 43 is not zero, the drive control device 24 controls to apply a voltage to the target pixel. After passing a predetermined period, when a condition to select b-number of the predetermined periods from among a-number of the predetermined periods is met, the remainder frequency update device 25 decrements the counter value stored in the remainder frequency memory 43 through the memory control device 21.

In this example, the control device 20 further has a memory device 26 and a decision device 27. The memory device 26 stores a table including plural sets of temperature and voltage application frequency. The a-number is the maximum value of the voltage application frequency included in the table. The decision device 27 decides the condition according to the temperature acquired by the acquisition device 22.

Figure 7:
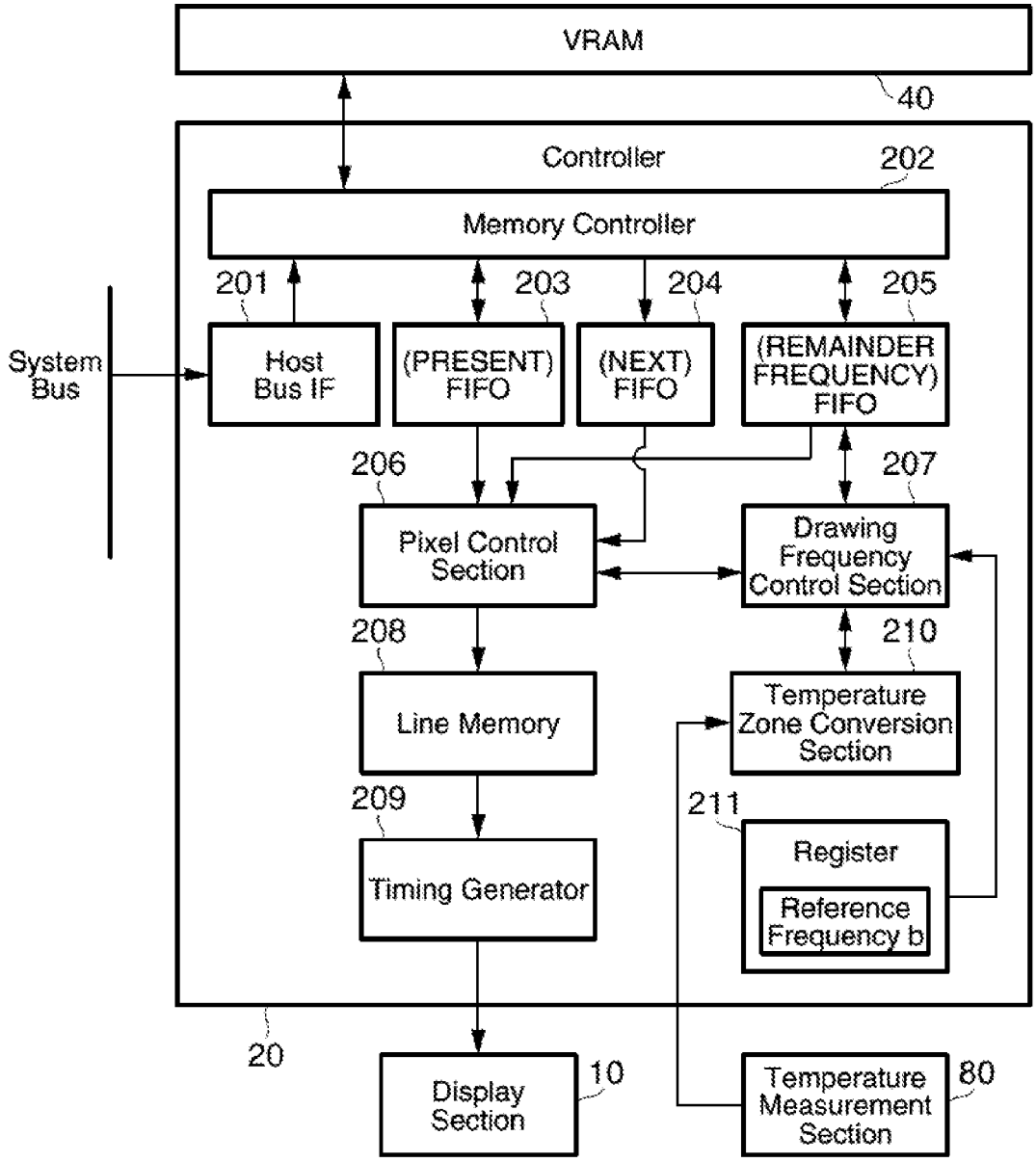
FIG. 7 is a view showing a concrete example of the configuration of the controller 20.

FIG. 7 is a diagram showing a concrete example of the composition of the controller 20. The controller 20 has a host bus IF 201, a memory controller 202, a FIFO (First In First Out) 203, a FIFO 204, a FIFO 205, a pixel control section 206, a drawing frequency control section 207, a line memory 208, a timing generator 209, a temperature zone conversion section 210, and a register 211.

The host bus IF 201 is an interface that inputs and outputs data through the system bus. The memory controller 202 writes data to an external memory, such as, VRAM 40 or reads data from an external memory. The FIFO 203, the FIFO 204, and the FIFO 205 are memories that store data read by the memory controller 202 from an external memory, or data to be written to an external memory. In particular, the FIFO 203 is a memory that stores data read from the present memory 41, or data to be written to the present memory 41. The FIFO 204 is a memory that stores data read from the next memory 42. The FIFO 205 is a memory that stores data read from the remainder frequency memory 4, or data to be written to the remainder frequency memory 43.

The pixel control section 206 controls data writing, for a target pixel, to the line memory 208. The drawing frequency control section 207 controls data reading and writing with respect to the FIFO 205, and data reading from the register 211, and additionally performs control concerning the drawing frequency (remainder frequency). The temperature zone conversion section 210 decides the voltage application frequency a based on temperature information. In this example, the temperature zone conversion section 210 stores a table that associates temperatures with voltage application frequencies. The register 211 is a memory that stores a reference frequency b of the remainder frequency. The line memory 208 is a memory that stores data indicative of application voltages about a target pixel group for one row among the plural pixels 14. The timing generator 209 reads out data from the line memory 208 according to a predetermined timing of every one frame, and supplies signals corresponding to the read data to the display section 10.

The memory controller 202 is an example of the memory control device 21. The temperature zone conversion section 210 is an example of the acquisition device 22. The temperature zone conversion section 210 and the register 211 are an example of the remainder frequency setting device 23. The pixel control section 206, the line memory 208, and the timing generator 209 are an example of the drive control device 25. The temperature zone conversion section 210 is an example of the storage device 26 and the decision device 27.

2. Operation

2-1. Outline of Operation

Figure 8:
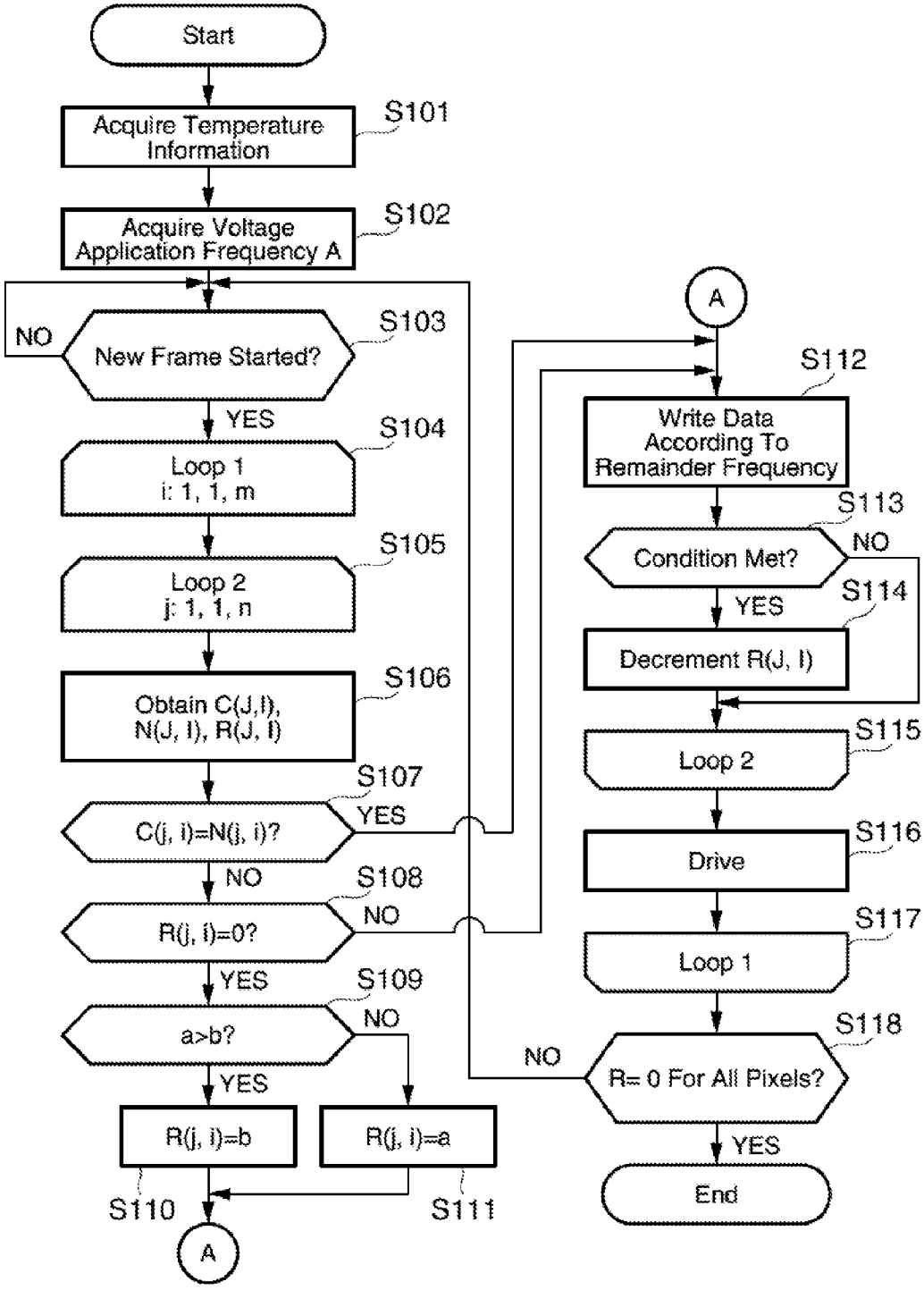
FIG. 8 is a flow chart of the operation of the controller 20.

FIG. 8 is a flow chart that shows the operation of the controller 20. The flow of FIG. 8 is started with the occurrence of an event that triggers the image rewriting. Such an event may be an event in which, for example, an image rewriting instruction was input from the CPU30.

In step S101, the temperature zone conversion section 210 acquires temperature information from the temperature measurement section 80. An output signal from the temperature measurement section 80 indicates the temperature. In step S102, the temperature zone conversion section 210 acquires a voltage application frequency a corresponding to the temperature indicated by the acquired temperature information. The temperature zone conversion section 210 stores the acquired voltage application frequency a in a built-in memory (not shown in the figure).

In step S103, the memory controller 202 judges as to whether a new frame is started. For example, the beginning of a new frame is shown by a synchronous signal output from a real time clock (not shown in the figure). When it is judged that a new frame was started (step S103: YES), the memory controller 202 shifts the processing to step S104. When it is judged that a new frame was not started (step S103: NO), the memory controller 202 stands by until a new frame is started.

In step S104, the memory controller 202 initializes a loop counter i of a processing loop 1. The loop counter i is a parameter that specifies the row to be processed. The loop counter i is initialized, in this example, by i=1. The loop counter i is incremented by one on the loop edge. The processing loop 1 is repeated for m rows, in other words, until i=m.

In step S105, the memory controller 202 initializes a loop counter j of a processing loop 2. The loop counter j is a parameter that specifies the column to be processed. In other words, the target pixel is a pixel at the i-$^{th}$ row and the j-$^{th}$ column. The loop counter j is initialized, in this example, by j=1. The loop counter j is incremented by one on the loop edge. The processing loop 2 is repeated for n columns, in other words, until j=n.

In step S106, the memory controller 202 obtains data indicative of the gray level value of the target pixel and the remainder frequency. Concretely, the memory controller 202 reads the gray level value C (j, i) of the present frame of the target pixel from the present memory 41, and writes the read gray level value in the FIFO 203. Moreover, the memory controller 202 reads the gray level value N (j, i) of the next image of the target pixel from the next memory 42, and writes the read gray level value in the FIFO 204. In addition, the memory controller 202 reads the remainder frequency R (j, i) of the target pixel from the remainder frequency memory 43, and writes the read index in the FIFO 205.

In step S107, the pixel control section 206 judges, for the target pixel, as to whether the gray level value C (j, i) of the present frame coincides with the gray level value N (j, i) of the next image. Concretely, the pixel control section 206 reads the gray level value C (j, i) from the FIFO 203, and the gray level value N (j, i) from the FIFO 204, respectively, and judges as to whether these two gray level values coincide with each other. When it is judged that these two gray level values coincide (step S107: YES), the pixel control section 206 shifts the processing to step S112. When it is judged that these two gray level values do not coincide (step S107: NO), the pixel control section 206 shifts the processing to step S108.

In step S108, the drawing frequency control section 207 judges as to whether the remainder frequency indicated by the remainder frequency R (j, i) is zero. Concretely, the drawing frequency control section 207 reads the remainder frequency R (j, i) from the FIFO 205. The drawing frequency control section 207 judges if the read remainder frequency R is zero. When the remainder frequency R is not zero (step S108: NO), the drawing frequency control section 207 shifts the processing to step S112. When the remainder frequency is zero (step S108: YES), the drawing frequency control section 207 shifts the processing to step S109.

In step S109, the drawing frequency control section 207 judges as to whether the voltage application frequency a and the reference frequency b satisfy a>b. Concretely, the drawing frequency control section 207 reads the voltage application frequency a and the reference frequency b from the memory and the register 211, respectively, and judges as to whether the relation a>b is established. When they are judged to satisfy a>b (step S109: YES), the drawing frequency control section 207 shifts the processing to step S110. When they are judged not to satisfy a>b (step S109: NO), the drawing frequency control section 207 shifts the processing to step 5111.

In step S110, the drawing frequency control section 207 sets the remainder frequency R (j, i) to R (j, i)=b. Concretely, the drawing frequency control section 207 writes the remainder frequency R (j, i) in the FIFO 205. The memory controller 202 reads the remainder frequency R (j, i) at the FIFO 205 and writes the read data to the remainder frequency memory 43.

In step S111, the drawing frequency control section 207 sets the remainder frequency R (j, i) to R (j, i)=a. Concretely, the drawing frequency control section 207 writes the remainder frequency R (j, i) to the FIFO 205. The memory controller 202 reads the remainder frequency R (j, i) at FIFO 205 and writes the read data to the remainder frequency memory 43.

In this example, the setting of the remainder frequency R, in step S110 and step S111, is limited to frames with the flag for decrementing the remainder frequency (to be described later) being "1".

In step S112, the pixel control section 206 writes data corresponding to the remainder frequency R (j, i) in the line memory 208. The data to be written here indicates the polarity and the voltage value of a voltage to be impressed to the electrophoretic element 143. In this example, the data to be written in the line memory 208 is either "−1", "0" or "1". For instance, when the remainder frequency R (j, i) indicates that white writing is carried out, "1" is written as data. When the remainder frequency R (j, i) indicates that black writing is carried out, "−1" is written as data. When the remainder frequency R (j, i) indicates that neither white writing nor black writing is carried out, "0" is written as data.

In step S113, the drawing frequency control section 207 judges as to whether the condition to decrement the remainder frequency R is met. In this example, the condition to decrement the remainder frequency R is a condition in which the value of the flag for decrementing the remainder frequency is "1". The flag for decrementing the remainder frequency is "1" in b-number of frames among consecutive a-number of frames, and is "0" in the other frames. This flag is "1" in all frames for a≤b. When it is judged that the condition to decrement the remainder frequency R was met (S113: YES), the drawing frequency control section 207 shifts the processing to step S114. If it is judged that the requirement to decrement the remainder frequency R is not met (S113: NO), the drawing frequency control section 207 shifts the processing to step S115.

As an algorithm to select b-number of frames from among a-number of frames, for instance, the following algorithm is used. First, the reciprocal 1/r of a scale factor r=a/b is calculated. The value 1/r is added to the result of the preceding frame, and when the addition result is 1.0 or more, the remainder frequency R is decremented. In the first frame, the addition result begins as 1.0. At the time of addition in the next frame, only a value below the decimal point in the addition result of the preceding frame is considered. A more concrete example is as follows.

Example 1 in case a=10, and b=7
Reciprocal 1/r=7/10=0.7

| Frame | Addition Result | Decrement | R |
|---|---|---|---|
| 1 | 1.0 | Yes | 6 |
| 2 | 0.0 + 0.7 = 0.7 | No | 6 |
| 3 | 0.7 + 0.7 = 1.4 | Yes | 5 |
| 4 | 0.4 + 0.7 = 1.1 | Yes | 4 |
| 5 | 0.1 + 0.7 = 0.8 | No | 4 |
| 6 | 0.8 + 0.7 = 1.5 | Yes | 3 |
| 7 | 0.5 + 0.7 = 1.2 | Yes | 2 |
| 8 | 0.2 + 0.7 = 0.9 | No | 2 |
| 9 | 0.9 + 0.7 = 1.6 | Yes | 1 |
| 10 | 0.6 + 0.7 = 1.3 | Yes | 0 |

In this example, the values of the flags for decrementing the remainder frequency repeat the pattern of 1, 0, 1, 1, 0, 1, 1, 0, 1, 1, every ten frames.

Example 2 in case of a=8, and b=7
Reciprocal 1/r=7/8=0.875

| Frame | Addition Result | Decrement | R |
|---|---|---|---|
| 1 | 1.0 | Yes | 6 |
| 2 | 0.000 + 0.875 = 0.875 | No | 6 |
| 3 | 0.875 + 0.875 = 1.750 | Yes | 5 |
| 4 | 0.750 + 0.875 = 1.625 | Yes | 4 |
| 5 | 0.625 + 0.875 = 1.500 | Yes | 3 |
| 6 | 0.500 + 0.875 = 1.375 | Yes | 2 |
| 7 | 0.375 + 0.875 = 1.250 | Yes | 1 |
| 8 | 0.250 + 0.875 = 1.125 | Yes | 0 |

In this example, the values of the flags for decrementing the remainder frequency repeat the pattern of 1, 0, 1, 1, 1, 1, 1, 1 every eight frames.

In step S114, the drawing frequency control section 207 decrements the remainder frequency R. Concretely, the drawing frequency control section 207 writes the decremented remainder frequency R (j, i) in the FIFO 205. The memory controller 202 reads out the data from the FIFO 205, and writes the read data in the storage area for the target pixel of the remainder frequency memories 43.

In step S115, the memory controller 202 processes the loop edge of the processing loop 2. Concretely, the memory controller 202 judges as to whether the loop counter j is j=n. When it is not j=n, the memory controller 202 increments the loop counter j, and shifts the processing to step S104. In case of j=n, the memory controller 202 shifts the processing to step S116.

In step S116, the timing generator 209 outputs a signal for driving the display section 10. Concretely, the timing generator 209 reads data from the line memory 208, and outputs the read data to the data line drive circuit 17 at the timing in synchronism with the scanning of the scanning lines 115. Moreover, when the first row is a row to be processed, the timing generator 209 outputs a signal for starting the scanning of the scanning lines 115 to the scanning line drive circuit 16. When the second row and thereafter is a row to be processed, the timing generator 209 outputs a signal indicative of the scanning timing to the scanning line drive circuit 16. In the display section 10, data is written at the pixels 14 of the $i^{-th}$ row by these signals.

In step S117, the memory controller 202 processes the loop edge of the processing loop 1. Concretely, the memory controller 202 judges as to whether the loop counter i is i=m. When it is not i=m, the memory controller 202 increments the loop counter i, and shifts the processing to step S106. In case of i=m, the memory controller 202 shifts the processing to step S118.

In step S118, the drawing frequency control section 207 judges as to whether the remainder frequency of all pixels is zero. For instance, whether the remainder frequency is zero for all pixels is judged based on a counter that indicates the number of pixels whose remainder frequency is other than 0. For instance, when the remainder frequency R (j, i) read from the remainder frequency memory 43 is not zero, the memory controller 202 adds "1" to the value of the counter. When the remainder frequency R (j, i) decremented in step S114 becomes zero, the pixel control section 206 subtracts "1" from the value of the counter. It is shown that the remainder frequency of all pixels is 0 when the value of the counter becomes zero. When it is judged that there is still a pixel with the remainder frequency that is not zero (step S118: NO), the drawing frequency control section 207 shifts the processing to step S103. When it is judged that the remainder frequency of all the pixels is zero (step S118: YES), the drawing frequency control section 207 ends the flow of FIG. 8.

2-2. Operation Example

FIG. 9 is a table showing an example of changes in the value of the remainder frequency R. In this example, a=7, and b=3. The remainder frequency R is decremented in the $1^{st}$, $4^{th}$, and $7^{th}$ frames, and is maintained in other frames.

FIG. 10 is a table showing another example of changes in the value of the remainder frequency R. In this example, a=10, and b=7. The remainder frequency R is decremented in the $1^{st}$, $3^{rd}$, $4^{th}$, $6^{th}$, $7^{th}$, $9^{th}$ and $10^{th}$ frames, and is maintained in other frames.

FIG. 11 is a table showing still another example of changes in the value of the remainder frequency R. In this example, a=3, and b=3. The remainder frequency R is decremented in the $1^{st}$, $2^{nd}$ and $3^{rd}$ frames.

FIG. 12 is a table showing yet another example of changes in the values of the remainder frequency R for two pixels. In this example, a=7, and b=3. Rewriting starts in the $1^{st}$ frame for the pixel A, and in the $4^{th}$ frame for the pixel B. The remainder frequency R is decremented in the $1^{st}$, $4^{th}$, $7^{th}$ and $10^{th}$ frames.

According to the present embodiment, the capacity of the remainder frequency memory can be reduced, compared with the composition in which the remainder frequency R is decremented in all frames, as explained above. This effect occurs due to the following reasons. The voltage application frequency a depends on the ambient temperature of the device. For instance, because the response of the electrophoretic element 143 becomes slower at a lower temperature, the voltage application frequency a becomes greater. More concretely, when the voltage application frequency a is 234 (a=234) (that is, amax=234), in the lower limit temperature within the range of the operating temperature of the electronic apparatus, the remainder frequency memory 43 needs to have a storage area in eight bits for each pixel. When a=15 in the vicinity of the room temperature, a storage area in four bits for each pixel may be sufficient. However, the storage area in eight bits is still necessary to operate at the lower limit temperature. In contrast, in accordance with the present embodiment, the storage area of the remainder frequency memory 43 can be reduced to a size smaller than In (amax) bits, with respect to the maximum value amax of the voltage application frequency a. For instance, even in the case of amax=234, the capacity of the remainder frequency memory 43 can be four bits (b=16) for each pixel. In this manner, in accordance with the present embodiment, the memory capacity of the remainder frequency memory 43 can be reduced. In addition, because the band of the VRAM40 decreases, the power consumption can be reduced.

3. Modification Example

The invention is not limited to the embodiments described above, and can be implemented in various forms. Hereafter, some modification examples will be described. Two or more of the modification examples may be used in combination.

3-1. Modification Example 1

The algorithm to select b frames from among a frames is not limited to the one explained in the embodiment. For example, to decrement always in the last frame (the $a^{-th}$ frame) in the a frames, (b−1) frames may be selected from among (a−1) frames, according to the method described in the embodiment. In this case, the reciprocal of a scale factor 1/r=(b−1)/(a−1) is first calculated. The value 1/r is added to the result of a preceding frame. When the addition result is 1.0 or greater, the remainder frequency R is decremented. Note that, in the first frame, the addition result is started as 1.0. At the time of addition in the next frame, only a value below the decimal point of the addition result in the preceding frame is considered. According to this example, the remainder frequency is decremented in the first frame and the $a^{-th}$ frame.

3-2. Modification Example 2

In the embodiment described above, an example is described in which the same initial value of the remainder frequency is used for the case of white writing and the case of black writing. However, different initial values of the remainder frequency may be used for the case of white writing and the case of black writing. In this case, the register 211 stores an initial value for white writing and another initial value for black writing. The drawing frequency control section 207 reads an initial value corresponding to the writing polarity from the register 211.

Moreover, in the modification example 1 described above, the voltage application frequency (that is, the initial value of the remainder frequency) differs depending on the combination of the gray level value P and the gray level value N. However, the initial value of the remainder frequency may be the same for the cases of white writing and black writing, even in the case of multiple-gray level display.

3-3. Modification Example 3

The composition of the controller 20 is not limited to the one exemplified in FIG. 7. If the function of FIG. 6 can be achieved, the controller 20 may have any composition. In another example, a section of the function of controller 20 may be realized by other elements, such as, the CPU30, the RAM 50 and the like. In this case, the electronic apparatus 1 only has to have the function described in FIG. 6 as a whole. Moreover, the operation of the controller 20, the order of the processings in particular is not limited to the one explained with reference to the flow shown in FIG. 8.

3-4. Other Modification Example

The electronic apparatus 1 is not limited to the electronic book leader. The electronic apparatus 1 may be a personal computer, a PDA (Personal Digital Assistant), a cellular phone, a smart phone, a tablet terminal or a portable game machine.

The equivalent circuit of the pixel 14 is not limited to the one described in the embodiment. The switching element and the capacitance element may be combined in any way, if they provide a composition in which a controlled voltage can be applied between the pixel electrode 114 and the common electrode 131. Moreover, the method of driving the pixels may be a two-pole drive in which the electrophoretic elements 143 with different polarities of application voltage exist in a single frame, or a single-pole drive in which voltage of the same polarity is applied in all the electrophoretic elements 143 in a single frame.

The structure of the pixel 14 is not limited to the one described in the embodiment. For instance, the polarity of charged particles is not limited to the one described in the embodiment. Black electrophoretic particles may be negatively charged, and white electrophoretic particle may be positively charged. In this case, the polarity of each voltage to be impressed to the pixels becomes reverse to the one explained in the embodiment. Moreover, the display element is not limited to an electrophoretic type display element using microcapsules. Other display elements, such as, a liquid crystal element, an organic EL (Electro Luminescence) element, etc. may be used.

The parameters (for example, the number of gray levels, the number of pixels, the voltage value, the voltage application frequency, etc.) explains in the embodiment are only examples, and the invention is not limited to these parameters.

The entire disclosure of Japanese Patent Application No. 2011-254245, filed Nov. 21, 2011 is expressly incorporated by reference herein.

What is claimed is:

1. A control device comprising:

a memory control device that controls access, for each of plural pixels corresponding to plural electro-optic elements whose optical state changes from a first state to a second state by voltage application a times each in a predetermined period as the unit, to a first memory that stores a present gray level value, a second memory that stores a gray level value to be displayed next, and a third memory that stores a counter value according to a remainder frequency of voltage applications;

an acquisition device that acquires temperature information indicative of temperature;

a remainder frequency setting device that, when rewriting of the gray level of a target pixel to be processed among the plural pixels starts in case when the temperature indicated by the temperature information acquired by the acquisition device is less than a threshold value, writes a value b (b<a) as the counter value stored in the third memory, for the target pixel, through the memory control device;

a drive control device that, when the remainder frequency indicated by the counter value stored in the third memory is not zero for the target pixel, controls to apply a voltage to the target pixel; and a remainder frequency update device that, after passing the predetermined period, when a condition to select b-number of the predetermined periods from among a-number of the predetermined periods is met, decrements the counter value stored in the third memory through the memory control device.

2. The control device according to claim 1, further comprising a memory device that stores a table including plural sets of temperature and voltage application frequency, the a-number being the maximum value of the voltage application frequency contained in the table.

3. The control device according to claim 1, further comprising a decision device that decides the condition according to the temperature acquired by the acquisition device.

4. An electro-optic device comprising the control device recited in claim 1 and the plural electro-optic elements.

5. An electronic apparatus comprising the electro-optic device recited in claim 4.

6. A control method for controlling an electro-optic device, the electro-optic device including a plurality of electro-optic elements whose optical state changes from a first state to a second state by voltage application a times each in a predetermined period as the unit, a control device, and a memory control device that controls access, for each of plural pixels corresponding to the plural electro-optic elements, to a first memory that stores a present gray level value, a second memory that stores a gray level value to be displayed next, and a third memory that stores a counter value according to a remainder frequency of voltage applications, the control method comprising:

acquiring temperature information indicative of temperature;

when rewriting of the gray level of a target pixel to be processed among the plural pixels starts in case when the temperature indicated by the temperature information acquired by the acquisition device is less than a threshold value, writing a value b (b<a) as the counter value stored in the third memory, for the target pixel;

when the remainder frequency indicated by the counter value stored in the third memory is not zero for the target pixel, controlling to apply a voltage to the target pixel; and, after passing the predetermined period, when a condition to select b-number of the predetermined periods from among a-number of the predetermined periods is met, decrementing the counter value stored in the third memory through the memory control device.

7. A control device comprising:

a memory control device that controls access, for each of plural pixels corresponding to plural electro-optic elements whose optical state changes from a first state to a second state by voltage application a times each in a predetermined period as the unit, to a first memory that stores a present gray level value, a second memory that stores a gray level value to be displayed next, and a third memory that stores a counter value according to a remainder frequency of voltage applications;

an acquisition device that acquires temperature information indicative of temperature;

a remainder frequency setting device that, when rewriting of the gray level of a target pixel to be processed among the plural pixels starts, writes a value b (b<a) as the counter value stored in the third memory, for the target pixel, through the memory control device;

a drive control device that, when the remainder frequency indicated by the counter value stored in the third memory is not zero for the target pixel, controls to apply a voltage to the target pixel; and a remainder frequency update device that, after passing the predetermined period, when a condition to select b-number of the predetermined periods from among a-number of the predetermined periods is met, decrements the counter value stored in the third memory through the memory control device.

8. A control method for controlling an electro-optic device, the electro-optic device including a plurality of electro-optic elements whose optical state changes from a first state to a second state by voltage application a times each in a predetermined period as the unit, a control device, and a memory control device that controls access, for each of plural pixels corresponding to the plural electro-optic elements, to a first memory that stores a present gray level value, a second memory that stores a gray level value to be displayed next, and a third memory that stores a counter value according to a remainder frequency of voltage applications, the control method comprising:

acquiring temperature information indicative of temperature;

when rewriting of the gray level of a target pixel to be processed among the plural pixels starts, writing a value b (b<a) as the counter value stored in the third memory, for the target pixel;

when the remainder frequency indicated by the counter value stored in the third memory is not zero for the target pixel, controlling to apply a voltage to the target pixel; and, after passing the predetermined period, when a condition to select b-number of the predetermined periods from among a-number of the predetermined periods is met, decrementing the counter value stored in the third memory through the memory control device.

* * * * *